US011745152B2

(12) United States Patent
Kaminaga

(10) Patent No.: US 11,745,152 B2
(45) Date of Patent: Sep. 5, 2023

(54) STIRRING DEVICE WITH A PEDESTAL THAT ROTATABLY SUPPORTS A ROTARY MEMBER AND SUPPORT MEMBER

(71) Applicant: SEIKO EPSON CORPORATION, Tokyo (JP)

(72) Inventor: Satoshi Kaminaga, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 382 days.

(21) Appl. No.: 16/740,902

(22) Filed: Jan. 13, 2020

(65) Prior Publication Data

US 2020/0222867 A1 Jul. 16, 2020

(30) Foreign Application Priority Data

Jan. 16, 2019 (JP) ..... 2019-004984

(51) Int. Cl.

| | |
|---|---|
| ***B01F 29/00*** | (2022.01) |
| ***B01F 101/35*** | (2022.01) |
| ***B01F 29/32*** | (2022.01) |
| ***B01F 35/42*** | (2022.01) |
| ***B41F 31/03*** | (2006.01) |
| ***B41J 2/175*** | (2006.01) |

(52) U.S. Cl.

CPC ..... *B01F 29/32* (2022.01); *B01F 35/42* (2022.01); *B01F 29/4032* (2022.01); *B01F 29/40362* (2022.01); *B01F 2101/35* (2022.01); *B41F 31/03* (2013.01); *B41J 2/17513* (2013.01)

(58) Field of Classification Search

CPC .... B01F 23/022; B01F 29/32; B01F 29/4032; B01F 29/40362; B01F 29/31; B01F 29/34; B01F 35/42; B01F 2101/35; B41F 31/03; B41J 2/17513; B41J 2/175; B41J 2/17523; B41J 2/17509; B41J 29/13

USPC ..... 366/208, 209, 210, 213, 214, 218

See application file for complete search history.

(56) References Cited

U.S. PATENT DOCUMENTS

| | | | | |
|---|---|---|---|---|
| 2,127,706 | A * | 8/1938 | Talbot | F25D 31/008 62/62 |
| 3,173,352 | A * | 3/1965 | Kingdon | G03D 13/043 366/230 |
| 3,430,927 | A * | 3/1969 | Pouzar | B01F 29/81 366/231 |
| 4,795,419 | A * | 1/1989 | Yawn | B04B 7/08 494/84 |
| 5,066,135 | A * | 11/1991 | Meyer | B01F 31/22 366/208 |
| 5,591,113 | A * | 1/1997 | Darnell | B04B 7/00 279/131 |

(Continued)

FOREIGN PATENT DOCUMENTS

| | | |
|---|---|---|
| JP | 2002200765 | 7/2002 |
| JP | 2017177509 | 10/2017 |

*Primary Examiner* — Charles Cooley

(74) *Attorney, Agent, or Firm* — WORKMAN NYDEGGER

(57) ABSTRACT

A stirring device includes a tray configured to hold an ink container filled with ink, a support member configured to support the tray, a rotary member configured to support the support member, and a pedestal configured to rotatably support the rotary member, in which the tray and the support member are engaged with each other by engagement portions provided on the tray and the support member (engagement cut-out portion, engagement convex portion).

8 Claims, 5 Drawing Sheets

(56) References Cited

U.S. PATENT DOCUMENTS

| | | | | |
|---|---|---|---|---|
| 11,478,763 | B2 * | 10/2022 | LaRose | B01F 29/10 |
| 2014/0269159 | A1 * | 9/2014 | Buse | B01F 35/511 366/218 |
| 2017/0368516 | A1 * | 12/2017 | Nichols | B01F 29/31 |
| 2022/0222867 | A1 * | 7/2022 | Sugio | G06T 9/004 |
| 2022/0281226 | A1 * | 9/2022 | Kudo | B41J 2/17559 |

* cited by examiner

STIRRING DEVICE WITH A PEDESTAL THAT ROTATABLY SUPPORTS A ROTARY MEMBER AND SUPPORT MEMBER

The present application is based on, and claims priority from JP Application Serial Number 2019-004984, filed Jan. 16, 2019, the disclosure of which is hereby incorporated by reference herein in its entirety.

BACKGROUND

1. Technical Field

The present disclosure relates to a stirring device.

2. Related Art

In printing apparatuses, the use of pigment ink in place of dye ink has been widespread. In addition, as an ink supply unit to a printing apparatus for large paper which requires a large amount of ink, there has been used an ink container having a bag-like shape and flexibility in which a large amount of ink can be filled. Note that, in the same manner as insertion of a paper cassette storing printing paper sheets, the tray is inserted into the printing apparatus in a state in which the ink container is disposed in a dedicated tray. When the tray is inserted into the printing apparatus, a hollow needle, which is at a printing apparatus side, for example, is inserted into an outlet of the ink container, and ink in the ink container is supplied to a head side where the ink is ejected.

Note that, since the pigment ink is an aqueous dispersion, when the ink container is maintained in the same posture, pigment particles are precipitated in the direction of gravity. Therefore, density unevenness occurs in the ink container, and density unevenness of printing is caused when the printing is performed.

JP-A-2017-177509 discloses a printing apparatus having a stirring mechanism for pressing an ink container in response to movement of a paper cassette, due to attachment or detachment, for storing printing paper sheets. With this configuration, when pigment ink is used, density unevenness in ink in the ink container can be suppressed.

However, in JP-A-2017-177509, since the stirring mechanism is provided inside a printing apparatus and is configured to cooperate with an operation of the paper cassette, there are concerns that the configuration inside the printing apparatus is complicated and a size of the printing apparatus is increased. When the stirring mechanism is configured as a stirring device separate from the printing apparatus in order to solve these concerns, the stirring device has challenges to be configured simply and to suppress occurrence of density unevenness in ink in an ink container.

SUMMARY

A stirring device according to the present disclosure includes a tray configured to hold an ink container filled with ink, a support member configured to support the tray, a rotary member configured to support the support member, and a pedestal configured to rotatably support the rotary member, in which the tray and the support member are engaged with each other by engagement portions provided on the tray and the support member.

In the above stirring device, a plurality of the trays may be stacked and engaged with the support member.

The stirring device according to the present disclosure includes a tray configured to hold an ink container filled with ink, a set member configured to set a plurality of the trays, a support member configured to support the set member, a rotary member configured to support the support member, and a pedestal configured to rotatably support the rotary member, in which the set member and the support member are engaged with each other by second engagement portions provided on the set member and the support member.

In the above stirring device, the support member may have an arm portion, and the engagement portion may be formed in the arm portion.

In the above stirring device, the support member may have an arm portion, and the second engagement portion may be formed in the arm portion.

In the above stirring device, a mounting portion configured to mount the tray may be formed in the set member.

In the above stirring device, the set member may include a slip-off preventing portion configured to prevent the tray from slipping off.

In the above stirring device, the support member and the rotary member may be integrally formed.

DESCRIPTION OF EXEMPLARY EMBODIMENTS

Hereinafter, embodiments of the present disclosure will be described with reference to the drawings. Note that, in the following figures, a scale of each member is made different from that of an actual one for convenience of explanation.

First Embodiment

Figure 1:
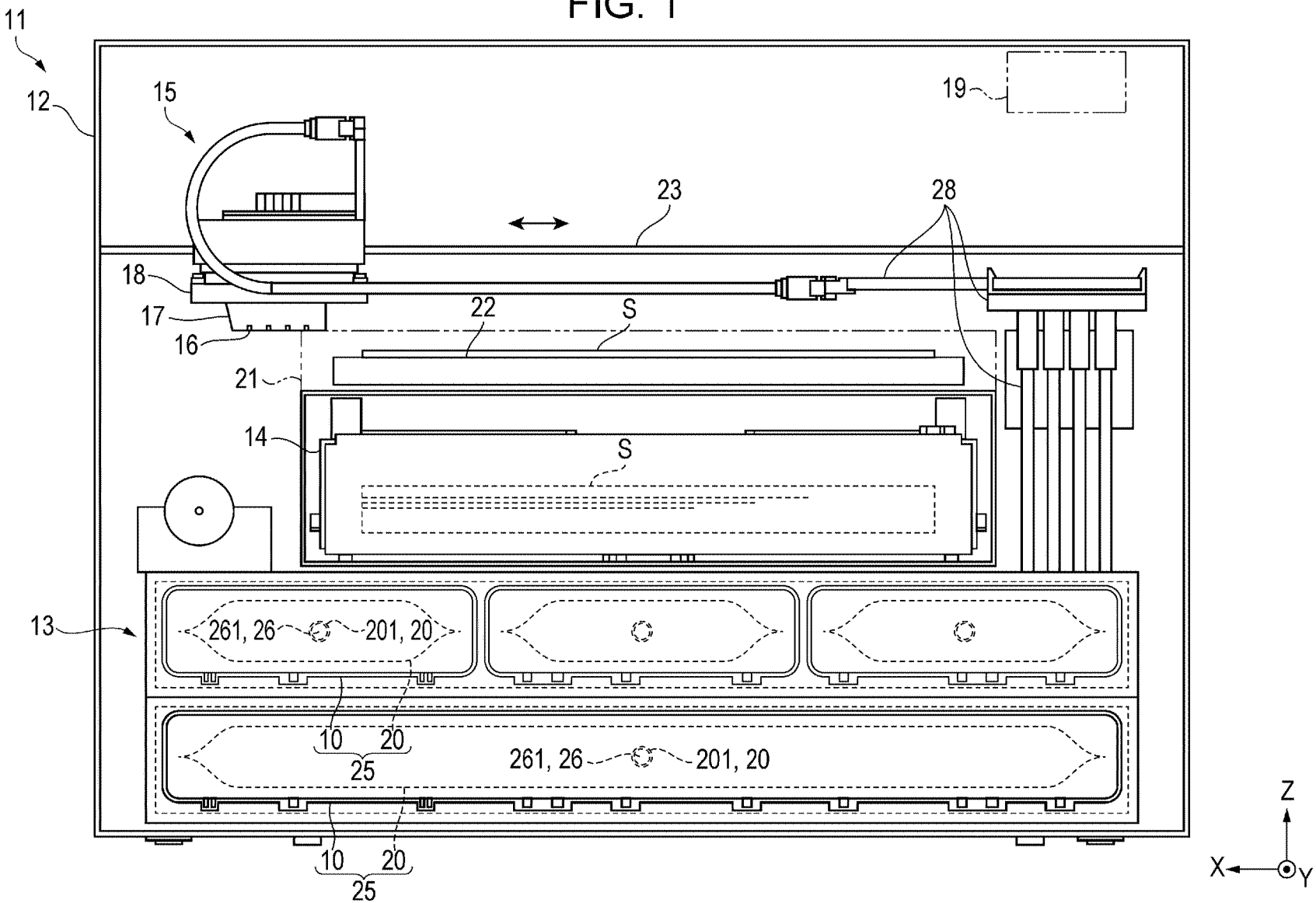
FIG. 1 is a front view illustrating an internal structure of a printing apparatus to which a tray according to a first embodiment is inserted.
Figure 2:
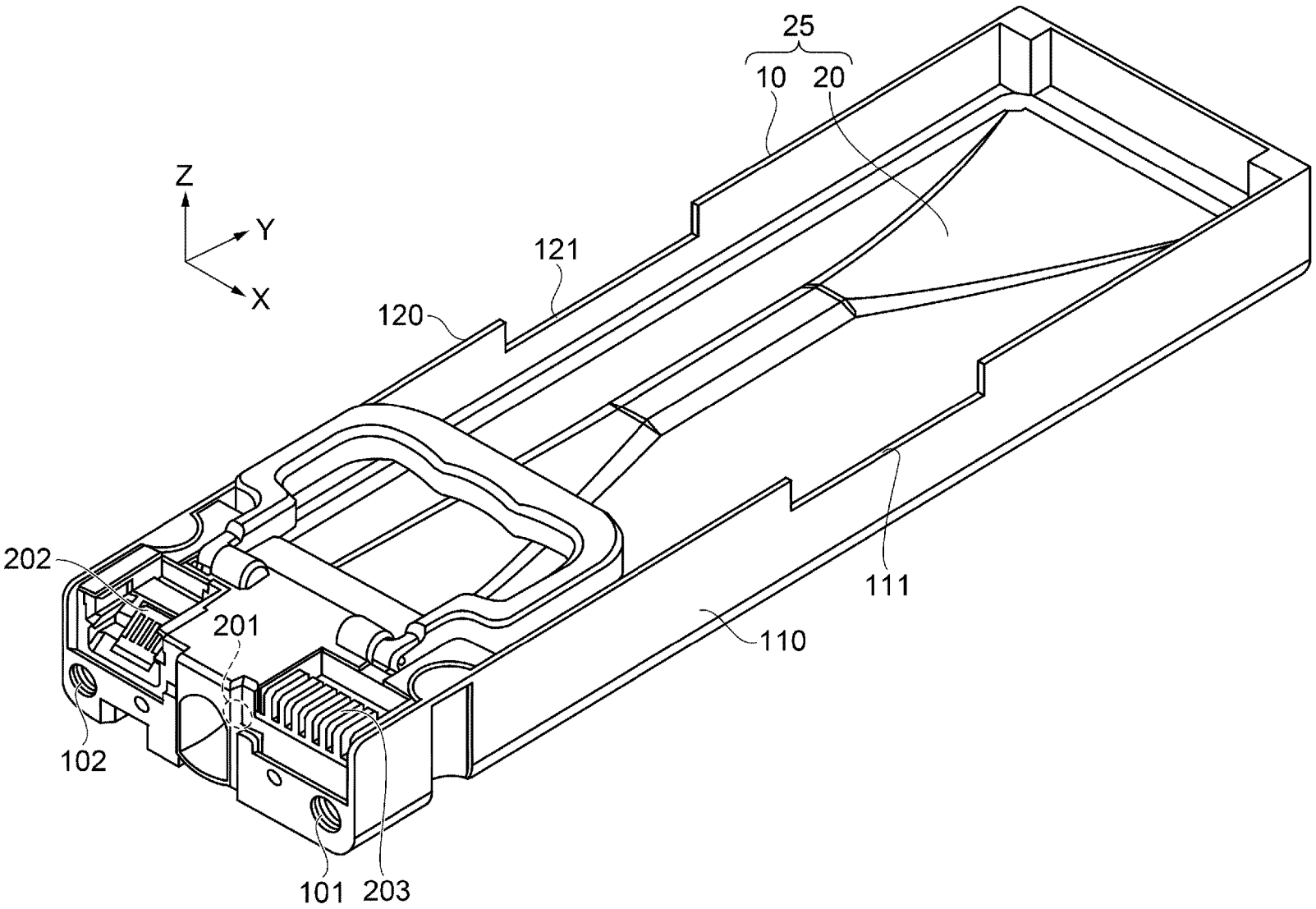
FIG. 2 is a perspective view illustrating a mount body to be mounted to a mounting portion.

FIG. 1 is a front view illustrating an internal structure of a printing apparatus 11 to which a tray 10 according to the first embodiment is inserted. FIG. 2 is a perspective view illustrating a mount body 25 to be mounted to a mounting portion 13.

Each of the diagrams in FIGS. 1 and 2 is illustrated by using an XYZ coordinate system. The X direction is a scanning direction of a head 17, and is a width direction of the printing apparatus 11. The Y direction is a depth direction of the printing apparatus 11, and is a direction in which the mount body 25 is attached and detached. The Z direction is a gravity direction, that is, a vertical direction, and is a height direction of the printing apparatus 11.

A front side of the apparatus is defined as a +Y direction, and a rear side of the apparatus is defined as a −Y direction. When the printing apparatus 11 is viewed from the front side, a left side of the apparatus is defined as a +X direction, and a right side of the apparatus is defined as a −X direction. Further, an upper side (including the above, an upper portion, an upper surface, and the like) of the apparatus is a +Z direction, and a lower side (including the below, a lower portion, a lower surface, a bottom portion, and the like) of the apparatus is a −Z direction.

As illustrated in FIG. 1, the printing apparatus 11 is provided with an outer casing 12 having a substantially rectangular parallelepiped shape. In the outer casing 12, a mounting portion 13 to which the tray 10 is detachably mounted, a paper cassette 14 configured to store printing paper sheets S, and a printing portion 15 configured to eject ink on the printing paper sheet S are disposed in this order from the bottom portion to the upper portion. A transport member 21 provided to the printing portion 15 takes out and transports the printing paper sheet S stored in the paper cassette 14 one by one, and disposes the printing paper sheet S on a paper support portion 22.

The printing portion 15 is provided with the head 17 configured to eject ink from a nozzle 16, and a carriage 18 configured to hold the head 17. A guide shaft 23 extending along the width direction indicated by an arrow is provided inside the outer casing 12. Operations of the printing portion 15 are controlled by a controller 19. The carriage 18 reciprocates along the scanning direction which coincides with the width direction of the printing apparatus 11. The head 17 moves together with the carriage 18 to eject ink supplied through the mounting portion 13 to print on the printing paper sheet S disposed on the paper support portion 22.

In the example illustrated in FIG. 1, four mount bodies 25 can be mounted to the mounting portion 13. The mount body 25 includes the tray 10 and an ink container 20 that has a bag-like shape and flexibility, and that is mounted on the tray 10. Each ink container 20 is filled with ink for printing. The ink is, for example, ink having a color such as black, cyan, magenta, yellow, or the like. A type of ink is, for example, pigment ink. The tray 10 is a container which can be attached to and detached from the mounting portion 13 in a state in which the ink container 20 is mounted on the tray 10. The tray 10 can be repeatedly used by replacing the ink container 20.

When each mount body 25 is attached to the mounting portion 13, a coupling portion 261 of a coupling unit 26 corresponding to each ink container 20 is inserted into an outlet 201 provided in the ink container 20. More specifically, a hollow needle (not illustrated) configuring the coupling portion 261 is inserted into the outlet 201 of the ink container 20. Each coupling unit 26 is coupled to the head 17 via a supply channel 28. The supply channel 28 is a channel for supplying ink from the coupling unit 26 to the head 17, and at least one channel is provided for each color.

As illustrated in FIG. 2, the mount body 25 includes the ink container 20 and the tray 10 on which the ink container 20 is mounted. The tray 10 is formed in a box shape and in a substantially rectangular parallelepiped shape. The ink container 20 includes a circuit substrate 202 and an identification portion 203 for preventing erroneous insertion in a width direction in which the outlet 201 is interposed, and the tray 10 has a pair of positioning holes (first positioning hole 101 and second positioning hole 102) on both sides in the width direction in which the outlet 201 of the ink container 20 is interposed.

Substantially at center portions of right and left side walls 110 and 120 in the depth direction (Y direction) of the tray 10, engagement cut-out portions 111 and 121 formed so as to descend from the upper surfaces of the side walls 110 and 120 are formed, respectively. The engagement cut-out portions 111 and 121 will be described later.

Figure 3:
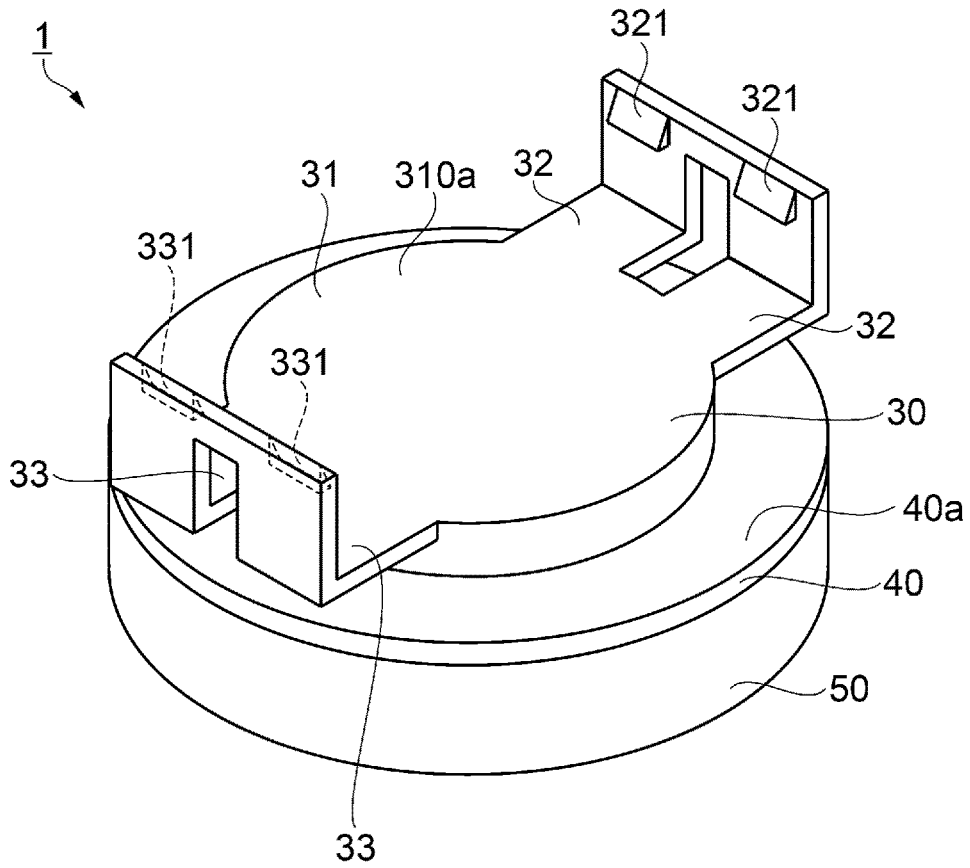
FIG. 3 is a schematic perspective view illustrating a stirring device.
Figure 4:
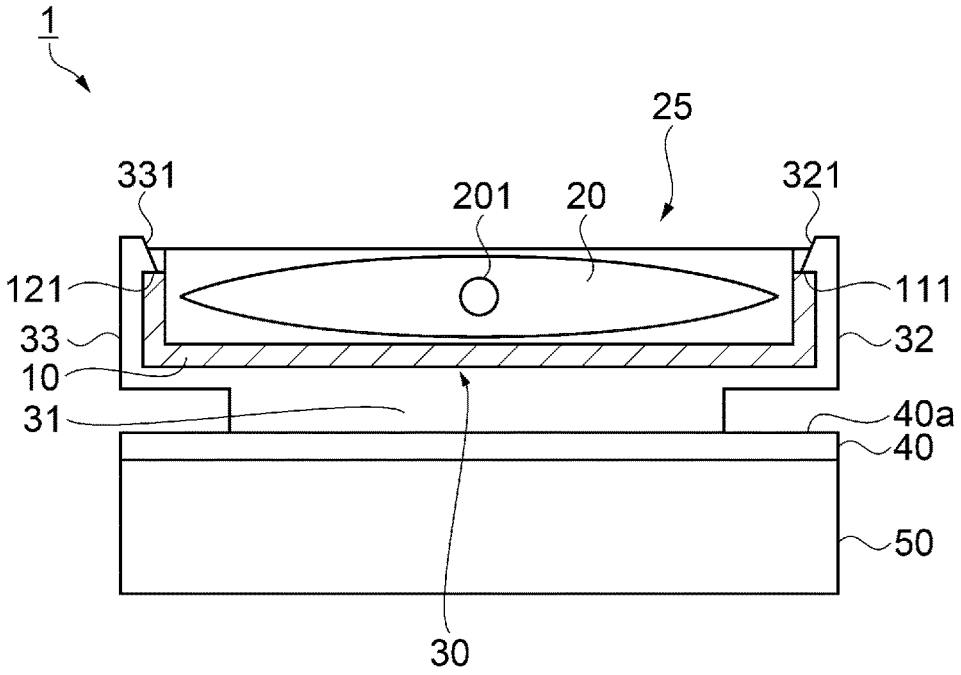
FIG. 4 is a schematic cross-sectional view illustrating a stirring device.

FIG. 3 is a schematic perspective view illustrating a stirring device 1 according to the first embodiment. FIG. 4 is a schematic cross-sectional view illustrating the stirring device 1. FIG. 4 is the schematic cross-sectional view of the mount body 25 (tray 10, ink container 20) mounted on a base portion 31 of a support member 30. In each of FIGS. 3 and 4, the stirring device 1 and the mount body 25 are simplified and illustrated.

The stirring device 1 according to the present embodiment is a device that supports and rotates the ink container 20 filled with the pigment ink to suppress precipitation of pigment components in the ink container 20. In this embodiment, the tray 10 in a state in which the ink container 20 is mounted and fixed on the tray 10 (in a state of the mount body 25) is disposed in the stirring device 1.

The stirring device 1 includes a support member 30, a rotary member 40, and a pedestal 50. The support member 30 is a member configured to support the tray 10, and a pair of arm portions 32 and a pair of arm portions 33 are individually formed on both sides of the substantially disk-shaped base portion 31. The arm portions 32 and 33 extend outward from an outer surface of the disk-shaped base portion 31, and are formed to be bent upward in the middle thereof.

When the center of the circular base portion 31 is set as a rotation axis, the arm portions 32 and 33 are formed to have a shape that is two-fold rotation symmetrical. The pair of arm portions 32 is coupled at upper portion thereof. The pair of arm portions 33 is also coupled at upper portion thereof. The shape of the arm portions 32 and 33 is a shape corresponding to stress in consideration of the stress applied to the arm portions 32 and 33 in supporting the tray 10.

An engagement convex portion 321 having a substantially triangular cross section projecting inward in a convex shape is formed on each of the upper portions of the pair of arm portions 32. Similarly, an engagement convex portion 331 having a substantially triangular cross section projecting inward in a convex shape is formed on each of the upper portions of the pair of arm portions 33.

When the tray 10 (the mount body 25) is mounted on the support member 30, the engagement convex portions 321 and 331 of the support member 30 are engaged with the engagement cut-out portions 111 and 121 of the tray 10. Specifically, a user grasps the mount body 25, and aligns a direction of the tray 10 such that the side wall 110 of the tray 10 is positioned on an arm portion 32 side and the side wall 120 is positioned on an arm portion 33 side, for example, from the above of the support member 30.

Then, the user moves the mount body 25 downward, and the side walls 110 and 120 on a bottom surface side of the tray 10 come into contact with the engagement convex portions 321 and 331, respectively, so that the arm portions 32 and 33 are pushed and expanded outward. Further, by pressing down the tray 10, the engagement convex portion 321 of the support member 30 is engaged with the engagement cut-out portion 111 formed in the side wall 110 of the tray 10. Similarly, the engagement convex portion 331 of the support member 30 is engaged with the engagement cut-out portion 121 formed in the side wall 120 of the tray 10. The direction of the tray 10 is not limited to the direction described above, and the tray 10 whose direction is horizontally rotated 180 degrees can be engaged with the support member 30.

The engagement cut-out portions 111 and 121 formed on the tray 10 and the engagement convex portions 321 and 331 formed on the support member 30 configure engagement portions for engaging the tray 10 with the support member 30.

The rotary member 40 is formed in a disk shape, and is a member that fixes the support member 30 to an upper surface 40*a* thereof to support the support member 30. Further, the pedestal 50 is a member that rotatably supports the rotary member 40. Note that the pedestal 50 has a weight as a fixing force for holding posture of the stirring device 1 itself when the ink container 20 is rotated.

Additionally, as illustrated in FIG. 4, in a state where the mount body 25 is engaged with the support member 30, an end of the tray 10 is pushed in a rotational direction, whereby the rotary member 40, the support member 30, and the mount body 25 start to rotate. When the mount body 25 rotates, the pigment components that are contained in the pigment ink filled in the ink container 20 and that are easily precipitated can be stirred.

Note that, the inventors have found, through experiments, that rotating the ink container 20 can remarkably efficiently stir the pigment components that are contained in the pigment ink and that are easily precipitated, compared to shaking the ink container 20 left and right.

As described above, according to the stirring device 1 of the present embodiment, the following effects can be obtained.

According to the stirring device 1 of the present embodiment, the stirring device 1 includes the support member 30, the rotary member 40, and the pedestal 50. Moreover, the tray 10 is supported by and fixed to the support member 30 by engaging the engagement cut-out portions 111 and 121 as engagement portions formed on the tray 10 with the engagement convex portions 321 and 331 as engagement portions formed on the support member 30. Due to the configuration in which the stirring mechanism is provided inside the printing apparatus and cooperates with an operation of the paper cassette, there have been concerns that the configuration inside the printing apparatus is complicated and the size of the printing apparatus is increased. In contrast, with the above-described configuration, the stirring device 1 can have a simple configuration by forming the stirring mechanism as the stirring device 1 separate from the printing apparatus 11. When the tray 10 is rotated in this state, the ink container 20 disposed in the tray 10 rotates. As a result, it is possible to efficiently stir the pigment components that are contained in the pigment ink filled into the ink container 20 and that are easily precipitated, and it is possible to suppress the density unevenness in the pigment ink.

According to the stirring device 1 of the present embodiment, the support member 30 has the arm portions 32 and 33, and the engagement convex portions 321 and 331 forming the engagement portions are formed at upper end portions of the arm portions 32 and 33, respectively, and are engaged with the engagement cut-out portions 111 and 121 formed on the tray 10, respectively. In this manner, by providing the support member 30 with the arm portions 32 and 33, the support member 30 can be easily adjusted to the height and width of the tray 10 when the tray 10 is supported by and fixed to the support member 30.

According to the stirring device 1 of the present embodiment, since the tray 10 is also used for the printing apparatus 11, the configuration is simplified compared to a case where another tray is separately provided.

Second Embodiment

Figure 5:
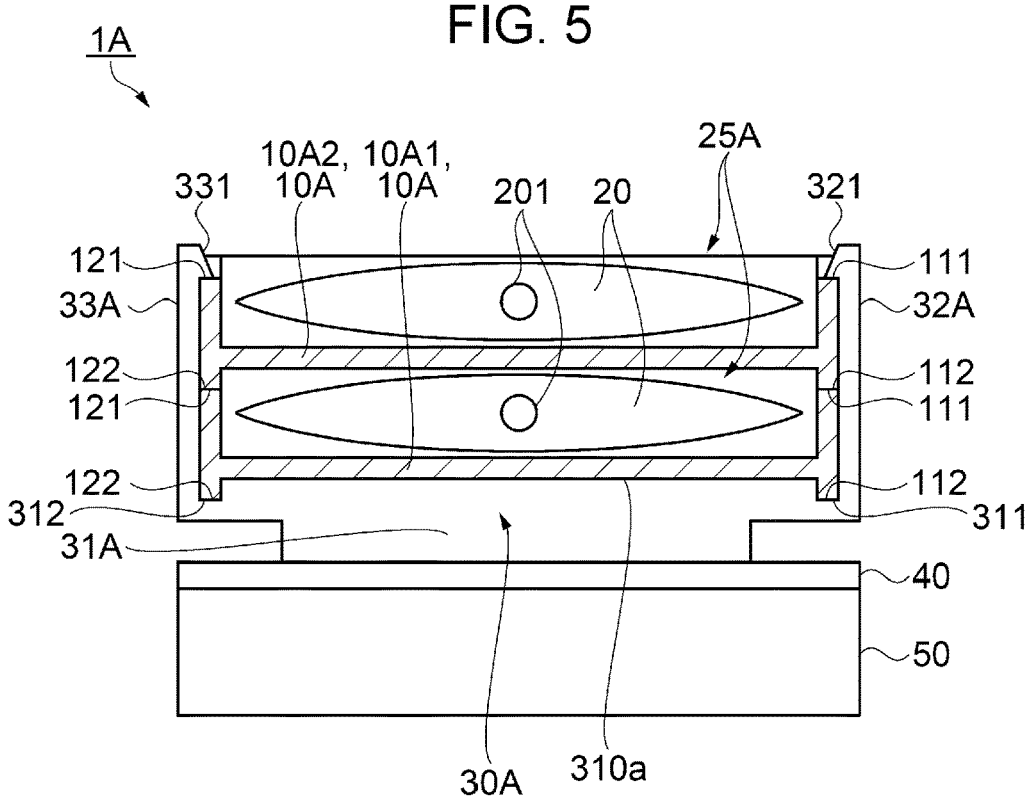
FIG. 5 is a schematic cross-sectional view illustrating a stirring device according to a second embodiment.

FIG. 5 is a schematic cross-sectional view illustrating a stirring device 1A according to the second embodiment. Specifically, FIG. 5 is the schematic cross-sectional view illustrating a plurality of mount bodies 25A (trays 10A and ink containers 20) mounted on a base portion 31A of a support member 30A. In FIG. 5, the stirring device 1A and the mount body 25A are simplified and illustrated.

As illustrated in FIG. 5, the tray 10A of the present embodiment is different from the tray 10 of the first embodiment in that engagement convex portions 112 and 122 projecting downward from bottom sides of the side wall 110 and 120 of the tray 10A are formed, respectively. The other configurations are the same as those of the tray 10 according to the first embodiment.

In detail, the engagement convex portion 112 formed on the tray 10A is formed at a position opposed to the engagement cut-out portion 111 on an upper surface side of the side wall 110. In addition, the engagement convex portion 112 is formed so as to have a length slightly shorter than a length, along the side wall 110, of the engagement cut-out portion 111. Similarly, the engagement convex portion 122 formed on the tray 10A is formed at a position opposed to the engagement cut-out portion 121 on an upper surface side of the side wall 120. The engagement convex portion 122 is formed so as to have a length slightly shorter than a length, along the side wall 120, of the engagement cut-out portion 121.

The stirring device 1A of the present embodiment is a device which is disposed by engaging the two mount bodies 25A (trays 10A, ink containers 20) in a stacked state with the support member 30A and which rotates the mount bodies 25A. The stirring device 1A includes the arm portions 32A and 33A of the support member 30A different from those of the stirring device 1 according to the first embodiment. The other configurations are the same as those of the stirring device 1 according to the first embodiment.

In detail, in the arm portions 32A and 33A of the present embodiment, in order to fix the trays 10A in a state where the two trays 10A are stacked vertically, lengths, in a height direction, of the arm portions 32A and 33A are longer than those of the arm portion 32 and 33 of the first embodiment. Additionally, groove portions 311 and 312 are formed on an upper surface 310*a* of the base portion 31A of the support member 30A at positions opposed to the engagement convex portions 112 and 122 of the tray 10A, respectively. Then, the groove portions 311 and 312 are engaged with the engagement convex portions 112 and 122 of the tray 10A.

Here, for the sake of convenience of description, the two trays 10A having the same configuration are referred to as a first tray 10A1 and a second tray 10A2.

A case where the tray 10A (the mount body 25A) is mounted on the support member 30A will be described.

First, a user grasps the first tray 10A1, and aligns a direction of the tray 10 such that the side wall 110 of the first tray 10A1 is positioned on an arm portion 32A side and the side wall 120 is positioned on an arm portion 33A side, viewed from the above of the support member 30A.

Then, the user moves the first tray 10A1 downward, and the side walls 110 and 120 on a bottom surface side of the tray 10 come into contact with the engagement convex portions 321 and 331, respectively, so that the arm portions 32A and 33A are pushed and expanded outward. Further, by pressing down the first tray 10A1, the first tray 10A1 is brought into contact with the upper surface 310*a* of the support member 30A. Note that, in this state, the engagement convex portions 112 and 122 of the first tray 10A1 are engaged with the groove portions 311 and 312 of the support member 30A, respectively.

Next, the user moves the second tray 10A2 downward, and the side walls 110 and 120 on the bottom surface side of the tray 10 come into contact with the engagement convex portions 321 and 331, respectively, so that the arm portions 32A and 33A are pushed and expanded outward. Further, by pressing down the second tray 10A2, the second tray 10A2 is brought into contact with the first tray 10A1. Note that, in this state, the engagement convex portions 112 and 122 of the second tray 10A2 are engaged with the engagement cut-out portions 111 and 121 of the first tray 10A1, respectively.

Moreover, in this state, the engagement convex portion 321 of the support member 30A is engaged with the engagement cut-out portion 111 formed in the side wall 110 of the second tray 10A2. Similarly, the engagement convex portion 331 of the support member 30A is engaged with the engagement cut-out portion 121 formed in the side wall 120 of the second tray 10A2. Thus, the first tray 10A1 and the second tray 10A2 are stacked and are engaged with the support member 30A to be fixed.

Note that, the engagement cut-out portions 111 and 121 formed on the second tray 10A2 and the engagement convex portions 321 and 331 formed on the support member 30A configure engagement portions for engaging the second tray 10A2 with the support member 30A. Additionally, the engagement cut-out portions 111 and 121 formed on the first tray 10A1 and the engagement convex portions 112 and 122 formed on the second tray 10A2 configure engagement portions for engaging the first tray 10A1 with the second tray 10A2. Moreover, the engagement convex portions 112 and 122 formed on the first tray 10A1 and the groove portions 311 and 312 formed on the support member 30A configure engagement portions for engaging the first tray 10A1 with the support member 30A.

Note that, as illustrated in FIG. 5, in the state in which the two mount bodies 25A are engaged with the support member 30A, an end of the tray 10A is pushed in a rotational direction, whereby the rotary member 40, the support member 30A, and the mount bodies 25A start to rotate. By the rotation of the mount body 25A, it is possible to stir the pigment components which are contained in the pigment ink filled in the ink container 20 and which are easily precipitated.

As described above, according to the stirring device 1A of the present embodiment, the following effects can be obtained.

In the stirring device 1A of the present embodiment, a plurality of the trays 10A (two in this embodiment) can be stacked to be engaged with the support member 30A. Thereby, two ink containers 20 can be rotated at a time, and the work for stirring the pigment components can be efficiently performed.

Third Embodiment

Figure 6:
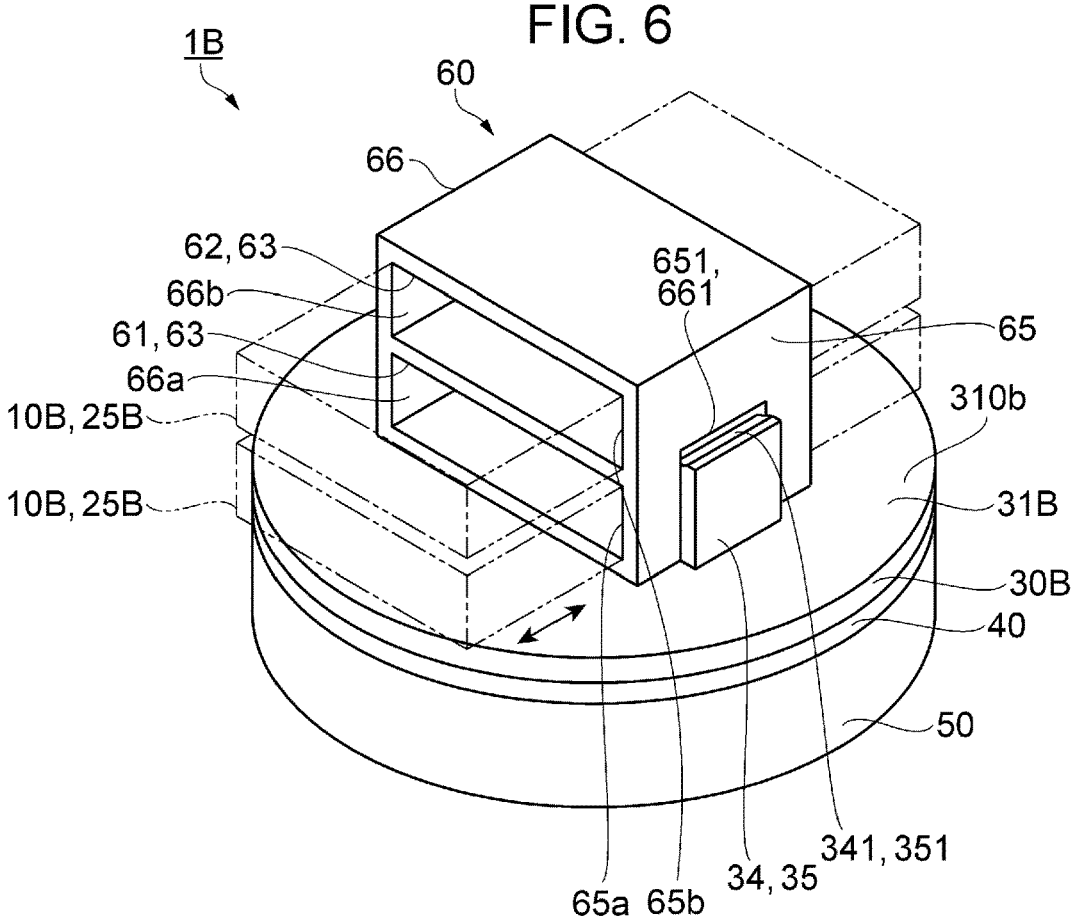
FIG. 6 is a schematic perspective view illustrating a stirring device according to a third embodiment.
Figure 7:
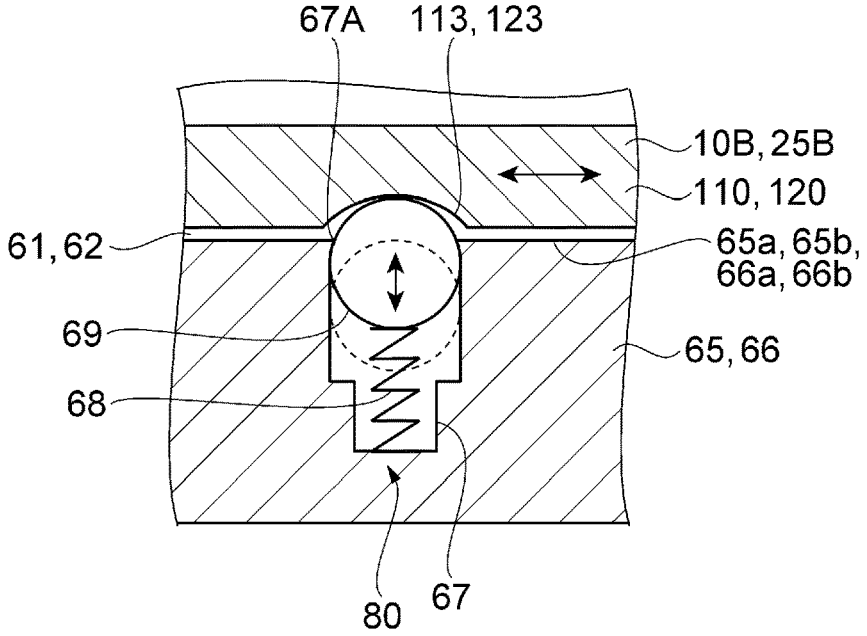
FIG. 7 is a schematic cross-sectional view illustrating a slip-off preventing portion.

FIG. 6 is a schematic perspective view illustrating a stirring device 1B according to the third embodiment. Specifically, FIG. 6 is the perspective view in which a set member 60 configured to set a plurality of trays 10B is disposed on a support member 30B. Note that, in FIG. 6, a mount body 25B and the tray 10B are simplified as a rectangular hexahedron, and are illustrated by a chain double-dashed line. FIG. 7 is a schematic cross-sectional view illustrating a slip-off preventing portion 80. Specifically, FIG. 7 is the cross-sectional view in a case where the slip-off preventing portion 80 is seen from above when the tray 10B is inserted into the set member 60.

As illustrated in FIG. 6, the stirring device 1B of the present embodiment is different from the stirring device 1 of the first embodiment in that the set member 60 configured to set the plurality of trays 10B is provided. Further, the support member 30B is fixed by engaging the set member 60 with an upper surface 310*b* of a base portion 31B.

The set member 60 includes a mounting portion 63 to which the tray 10B is mounted. The mounting portion 63 is formed by arranging two rectangular insertion holes 61 and 62 in a vertical direction. The trays 10B are inserted into the two insertion holes 61 and 62 in a depth direction of the insertion holes 61 and 62 to be fixed.

Engagement slit portions 651 and 661 for fixing the set member 60 to the support member 30B are respectively formed on side walls 65 and 66, opposed to each other, of the set member 60. Arm portions 34 and 35 extending upward are formed on the upper surface 310*b* of the base portion 31B so as to oppose the side walls 65 and 66 of the set member 60, respectively. Engagement convex portions 341 and 351 each of which has a substantially triangular cross section projecting inward is formed on upper portions of the arm portions 34 and 35, respectively. In addition, the engagement slit portions 651 and 661 of the set member 60 and the engagement convex portions 341 and 351 of the support member 30B configure the second engagement portions.

When the set member 60 is disposed on the support member 30B, the user first aligns the side walls 65 and 66 of the set member 60 in a direction of the arm portions 34 and 35. Next, the set member 60 is moved downward, and is mounted on the upper surface 310*b* while being brought into contact with the engagement convex portions 341 and 351 at the side walls 65 and 66.

In this state, the engagement convex portions 341 and 351 of the support member 30B are engaged with the engagement slit portions 651 and 661 of the set member 60, respectively. Thus, the set member 60 is supported by and fixed to the support member 30B.

As illustrated in FIG. 7, in the side wall 65 of the set member 60, the slip-off preventing portion 80 for preventing the tray 10B from slipping off is formed in an inner surface 65*a* configuring the insertion hole 61. FIG. 7 illustrates a configuration of the single slip-off preventing portion 80.

With reference to FIG. 7, a description will be given of the configuration of the slip-off preventing portion 80. The slip-off preventing portion 80 is formed with a hole portion 67 formed by a two-stage circular hole on the inner surface 65*a*. A metal ball 69 and a metal compression coil spring 68 are disposed in the hole portion 67. The ball 69 is normally pressed by the compression coil spring 68 to be pressed against an opening 67A of the hole portion 67, so that an outer surface of the ball 69 is partially projected into the insertion hole 61. When the outer surface of the projecting ball 69 is pressed toward the side wall 65, the ball 69 enters into the hole portion 67.

The two slip-off preventing portions 80 described above are formed in a direction in which the insertion hole 61 extends, on the inner surface 65*a*. Further, the slip-off preventing portions 80 are oppositely formed on an inner surface 66*a* of the side wall 66 opposed to the inner surface 65*a*. Further, the two slip-off preventing portions 80 are formed on an inner surface 65*b* configuring the insertion hole 62 on the side wall 65 in a direction in which the insertion hole 62 extends. The slip-off preventing portions 80 are also oppositely formed on the inner surface 66*b* of the side wall 66 opposed to the inner surface 65*b*.

In the tray 10B of the present embodiment, a receiving portion 113 for receiving the ball 69 is formed on the outer surface of the side wall 110 so as to correspond to the slip-off preventing portion 80. The receiving portion 113 is formed on the outer surface of the side wall 110 by a curved surface that is recessed inward. Two receiving portions 113 are formed so as to have a pitch equal to that of the two slip-off preventing portions 80 formed on the inner surface 66*a* of the side wall 66 of the set member 60. Further, in the tray 10B, two receiving portions 123 for receiving the ball 69 are formed on the outer surface of the side wall 120 so as to correspond to the slip-off preventing portions 80, similarly to the receiving portion 113.

When the tray 10B is inserted into the insertion hole 61 of the set member 60, the user first inserts the tray 10B into the insertion hole 61 such that the side walls 110 and 120 of the tray 10B are aligned with the inner surfaces 65*a* and 66*a* of the insertion hole 61, as illustrated in FIG. 6. When the insertion of the tray 10B is continued, the ball 69 in the slip-off preventing portion 80 formed on the inner surface 65*a* is pressed against the outer surface of the side wall 110 of the tray 10B, so that the insertion is performed. In this case, the ball 69 is pressed into the hole portion 67.

When the insertion of the tray 10B is continued and the receiving portion 113 formed on the side wall 110 of the tray 10B is positioned at a position of the ball 69 in the slip-off preventing portion 80, the ball 69 pressed by the compression coil spring 68 enters into the receiving portion 113. At this time, the other ball 69 also enters into the other receiving portion 113. At the same time, the balls 69 also enter into the two receiving portions 123 formed on the side wall 120 of the tray 10B. By this state, the tray 10B is fixed to the insertion hole 61.

By similarly inserting another tray 10B in the insertion hole 62, the tray 10B is fixed to the insertion hole 62 in the same manner as in the insertion hole 61.

When the tray 10B is pulled out from the insertion hole 61, the tray 10B is gripped and pulled by applying force in a pull-out direction. By this operation, when the pulling force reaches a predetermined force for the balls 69 entering into the receiving portion 113 and the receiving portion 123, a state of the balls 69 is changed to a state where the balls 69 are pressed by the outer surfaces of the side walls 110 and 120, from a state where the balls 69 are pressed by the receiving portions 113 and 123, and the balls 69 are moved to the inside of the hole portions 67. In this state, the tray 10B can be pulled out from the insertion hole 61. When the tray 10B is pulled out from the insertion hole 62, the tray 10B can be pulled out by the same operation as described above.

As illustrated in FIG. 6, in a state where the two trays 10B (the mount bodies 25B) are fixed to the mounting portion 63 (the insertion holes 61 and 62) of the set member 60, the rotary member 40, the support member 30B, the set member 60, and the mount bodies 25B start to rotate by pushing an end of the tray 10B in a rotational direction. When the tray 10B is rotated, the tray 10B is prevented from slipping off due to the centrifugal force because of the rotation by the slip-off preventing portion 80. By the rotation of the mount body 25B, it is possible to stir the pigment components which are contained in the pigment ink filled in the ink container 20 and which are easily precipitated.

As described above, according to the stirring device 1B of the present embodiment, the following effects can be obtained.

The stirring device 1B of the present embodiment includes the tray 10B, the support member 30B, the rotary member 40, and the pedestal 50. Additionally, the stirring device 1B includes a set member 60 configured to set the plurality of trays 10B (two in this embodiment). The support member 30B and the set member 60 are engaged with each other by the second engagement portions (the engagement slit portions 651 and 661 of the set member 60 and the engagement convex portions 341 and 351 of the support member 30B). By configuring the stirring device 1B in this manner, the stirring device 1B can be configured to have a simple configuration, similarly to the first embodiment. Further, the set member 60 can be securely fixed to the support member 30B by the second engagement portions. Further, the two ink containers 20 can be rotated at a time, so that the work for stirring the pigment components can be efficiently performed.

According to the stirring device 1B of the present embodiment, the support member 30B has the arm portions 34 and 35, and the engagement convex portions 341 and 351 forming the second engagement portions are formed at upper end portions of the arm portions 34 and 35, and are engaged with the engagement slit portions 651 and 661 of the set member 60. In this manner, since the support member 30B includes the arm portions 34 and 35, when the set member 60 is supported by and fixed to the support member 30B, it is possible to easily adjust the height and width of the set member 60.

According to the stirring device 1B of the present embodiment, the mounting portion 63 (insertion holes 61 and 62) to which the trays 10B are mounted is formed in the set member 60. Thus, the tray 10B can be easily disposed in the mounting portion 63.

According to the stirring device 1B of the present embodiment, the slip-off preventing portion 80 for preventing the tray 10B from slipping off is provided. Thus, the tray 10B can be maintained in a state in which the tray 10B is mounted to the mounting portion 63. Also, when the tray 10B is rotated, it is possible to prevent the tray 10B from slipping off due to the centrifugal force because of the rotation.

Fourth Embodiment

Figure 8:
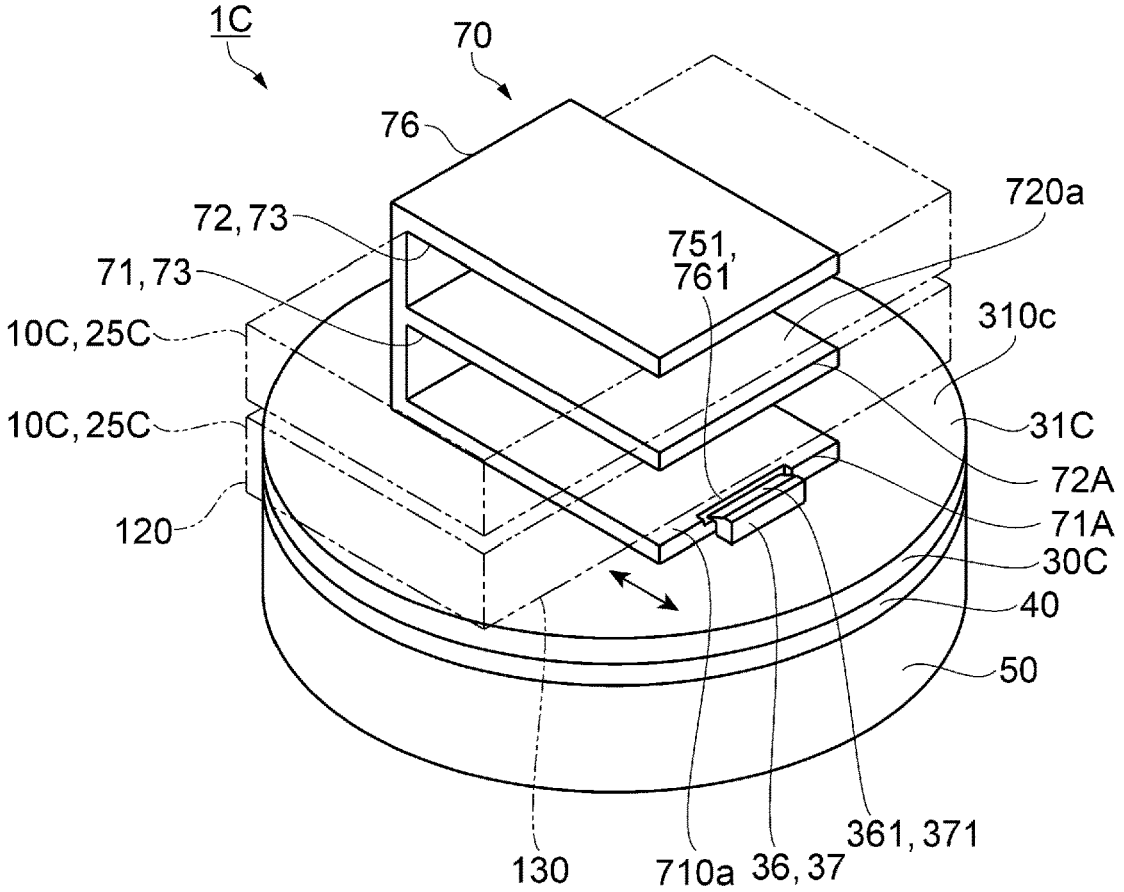
FIG. 8 is a schematic perspective view illustrating a stirring device according to a fourth embodiment.

FIG. 8 is a schematic perspective view illustrating a stirring device 1C according to the fourth embodiment. Specifically, FIG. 8 is a perspective view in a state in which a set member 70 configured to set a plurality of trays 10C is disposed on a support member 30C. In FIG. 8, a mount body 25C and the tray 10C are simplified as a rectangular hexahedron, and are illustrated by a chain double-dashed line.

As illustrated in FIG. 8, a structure of the set member 70 of the stirring device 1C according to the present embodiment is different from that of the stirring device 1B according to the third embodiment.

A cross section of the set member 70 is formed in an E-shape. Moreover, the set member 70 has an appearance in which the side wall 65 is removed from the set member 60 according to the third embodiment.

The set member 70 includes a mounting portion 73 to which the tray 10C is mounted. The mounting portion 73 is formed by arranging two insertion portions 71 and 72 in a vertical direction. As for the two insertion portions 71 and 72, the trays 10C are inserted and fixed into a side wall 76 side which is in a depth direction of the insertion portions 71 and 72. Specifically, the user grasps the tray 10C, and inserts, for example, the side wall 120 of the tray 10C into the side wall 76 side from an insertion port 71A of the insertion portion 71. Similarly, the user grasps another tray 10C, and inserts, for example, the side wall 120 of the tray 10C into the side wall 76 side from an insertion port 72A of the insertion portion 72.

An engagement cut-out portion 751 for fixing the set member 70 to the support member 30C is formed in the insertion port 71A of the set member 70. In addition, an engagement cut-out portion 761 for fixing the set member 70 to the support member 30C is formed at a position opposed to the insertion port 71A on the side wall 76 of the set member 70.

Arm portions 36 and 37 extending upward are formed on an upper surface 310*c* of a base portion 31C so as to oppose the engagement cut-out portions 751 and 761 of the set member 70, respectively. Engagement convex portions 361 and 371 each of which has a substantially triangular cross section projecting inward are formed on upper portions of the arm portions 36 and 37, respectively. Note that, the engagement cut-out portions 751 and 761 of the set member 70 and the engagement convex portions 361 and 371 of the support member 30C configure second engagement portions.

When the set member 70 is disposed on the support member 30C, the user first aligns the insertion port 71A and the side wall 76 of the set member 70 in a direction of the arm portions 36 and 37. Next, the set member 70 is moved downward, and is mounted on the upper surface 310*c* while being brought into contact with the engagement convex portions 361 and 371 at the insertion port 71A and the side wall 76.

In this state, the engagement convex portions 361 and 371 of the support member 30C are engaged with the engagement cut-out portions 751 and 761 of the set member 70, respectively. Thus, the set member 70 is supported by and fixed to the support member 30C.

A plurality of slip-off preventing portions 80 described in the third embodiment is formed on an upper surface 710*a* of the insertion portion 71 of the set member 70. In the present embodiment, the ball 69 is disposed in a state in which the outer surface of the ball is projected upward. The tray 10C is fixed to the insertion portion 71 by engaging the slip-off preventing portions 80 with receiving portions (not illustrated) that are formed on a bottom surface 130 of the tray 10C and that are configured in the same manner as the receiving portion 113 of the third embodiment. The plurality of slipping-off preventing portions 80 is similarly formed on an upper surface 720*a* of the insertion portion 72, and the tray 10C is fixed to the insertion portion 72 by engaging the slip-off preventing portions 80 with receiving portions (not illustrated) formed on the tray 10C.

As described above, according to the stirring device 1C of the present embodiment, it is possible to obtain the same effects as the stirring device 1B of the third embodiment.

According to the stirring device 1C of the present embodiment, the user can insert the side wall 120 of the tray 10C into a side wall 76 side from the insertion port 71A of the insertion portion 71 of the set member 70 by grasping the tray 10C, and the tray 10C can be easily set to the set member 70 in comparison with the stirring device 1B of the third embodiment.

The present disclosure is not limited to the embodiments described above, and various modifications and improvements can be made to the above-described embodiments. Variations will be described below.

Variation 1

In the stirring device 1 according to the first embodiment, an amount of outward extension of each of the arm portions 32 and 33 from the base portion 31 can be varied, so that even when a lateral width of the ink container 20 is changed, it is possible to support and fix the ink container 20 in response to the lateral width thereof, thereby improving the convenience of the stirring device 1.

Variation 2

In the stirring device 1A according to the second embodiment, the two trays 10A are stacked to be engaged with the support member 30A, but the present disclosure is not limited thereto, and three or more trays 10A may be stacked.

Variation 3

The set member 60 in the stirring device 1B according to the third embodiment includes the two insertion holes 61 and 62 as the mounting portion 63, and the two trays 10B are inserted into and fixed to the insertion holes 61 and 62. However, the present disclosure is not limited thereto, and three or more insertion holes may be formed in the set member 60, and the three or more trays 10B may be inserted into and fixed to the insertion holes correspondingly. This is the same for the set member 70 of the fourth embodiment.

Variation 4

In the stirring device 1 according to the first embodiment, as engagement portions for engaging the tray 10 and the support member 30, the engagement cut-out portions 111 and 121 which are formed so as to descend from the upper surface of the tray 10, and engagement convex portions 321 and 331 each of which has a substantially triangular cross section projecting inward and which are formed on the support member 30 are taken as an example. However, the present disclosure is not limited thereto, and may include various engagement portions. The same applies to the configurations of the engagement portions and the second engagement portions in the second, third, and fourth embodiments.

Variation 5

In the stirring device 1 according to the first embodiment, the arm portions 32 and 33 configured to hold the tray 10 are provided on the support member 30 (base portion 31). In addition, in the stirring device 1B of the third embodiment, the support member 30B (base portion 31B) is provided with the arm portions 34 and 35 configured to hold the set member 60 configured to set the plurality of trays 10. However, the present disclosure is not limited thereto, and the support member 30 (base portion 31) and the rotary member 40 may be integrally formed. Further, the support member 30B (base portion 31B) and the rotary member 40 may be integrally formed. As a result, for example, the arm portions 32 and 33 of the first embodiment may be provided on the rotary member 40, or the arm portions 34 and 35 of the third embodiment may be provided on the rotary member 40. With this configuration, it is possible to simplify the configurations of the stirring devices 1 and 1B. This also applies to the configurations of the stirring devices 1A and 1C of the second and fourth embodiments.

The contents derived from the above embodiments will be described below.

The stirring device includes a tray configured to hold an ink container filled with ink, a support member configured to support the tray, a rotary member configured to support the support member, and a pedestal configured to rotatably support the rotary member, in which the tray and the support member are engaged with each other by engagement portions provided on the tray and the support member.

According to this configuration, the stirring device includes the tray, the support member, the rotary member, and the pedestal. The tray is supported by and fixed to the support member by engaging the engagement portion formed on the support member with the engagement portion formed on the tray. Due to a configuration in which a stirring mechanism is provided inside a printing apparatus and cooperates with an operation of a paper cassette, there have been concerns that the configuration inside the printing apparatus is complicated, and the size of the printing apparatus is increased. In contrast, with the above-described configuration, a stirring device can have a simple configuration by forming a stirring mechanism as the stirring device separate from a printing apparatus. When the tray is rotated in this state, an ink container disposed on the tray rotates. As a result, it is possible to efficiently stir pigment components which are contained in the pigment ink filled in the ink container and which are easily precipitated, and to suppress density unevenness of the pigment ink.

In the stirring device, a plurality of the trays may be stacked and engaged with the support member.

According to this configuration, by engaging the stacked plurality of trays with the support member, a plurality of ink containers can be rotated at a time, and the work for stirring the pigment components can be efficiently performed.

The stirring device includes a tray configured to hold an ink container filled with ink, a set member configured to set a plurality of trays, a support member configured to support the set member, a rotary member configured to support the support member, and a pedestal configured to rotatably support the rotary member, in which the set member and the support member are engaged with each other by second engagement portions provided on the set member and the support member.

According to this configuration, the stirring device includes the tray, the support member, the rotary member, and the pedestal. According to this configuration, the set member is provided so as to be able to set the plurality of trays, and the support member and the set member are engaged with each other by having the second engagement portions, whereby the set member is supported by and fixed to the support member. By configuring the stirring device in this manner, the stirring device can have a simple configuration, compared to the case where the stirring mechanism is provided inside the printing apparatus. In addition, when the tray is rotated in this state, the ink container disposed in the tray rotates. As a result, it is possible to efficiently stir pigment components which are contained in the pigment ink filled in the ink container and which are easily precipitated, and to suppress density unevenness of the pigment ink. Further, a plurality of ink containers can be rotated at a time by the set member, and the work for stirring the pigment components can be efficiently performed.

In the stirring device, the support member may have an arm portion, and the engagement portion may be formed on the arm portion.

According to this configuration, by forming the arm portion on the support member and forming the engagement portion on the arm portion, a height and a width when the support member is engaged with the tray or the set member can be easily adjusted by adjusting a length of the arm portion, thereby improving degree of freedom in the engagement.

In the stirring device, the support member may have an arm portion, and the second engagement portion may be formed on the arm portion.

According to this configuration, by forming the arm portion on the support member and forming the second engagement portion on the arm portion, adjustment of the height and width when the arm portion is engaged with the tray or the set member can be easily adjusted by adjusting the length of the arm portion, thereby improving the degree of freedom in the engagement.

In the stirring device, a mounting portion configured to mount the tray is formed in the set member.

According to this configuration, the mounting portion configured to mount the tray is formed in the set member. Thus, it is possible to easily dispose the tray in the mounting portion.

In the stirring device, the set member includes a slip-off preventing portion for preventing the tray from slipping off.

According to this configuration, the set member includes the slip-off preventing portion for preventing the tray from slipping off. As a result, it is possible to maintain a state in which the tray is mounted on the mounting portion. Also, even when the tray is rotated, it is possible to prevent the tray from slipping off due to centrifugal force because of rotation.

In the above stirring device, the support member and the rotary member are integrally formed.

According to this configuration, for example, by forming the arm portion configured to hold the tray on the rotary member, the arm portion configured to hold the set member configured to set the plurality of trays, and the like, the configuration of the stirring device can be simplified.

What is claimed is:

1. A stirring device comprising:

a first tray configured to hold an ink container filled with ink, the first tray comprising a cut-out engagement portion formed in a side wall of the first tray;

a support member configured to support the tray, the support member comprising a base with a pair of arm portions, wherein with a center of the base being a rotational axis, the pair of arm portions are formed to have a two-fold rotational symmetry, wherein the support member supports the support tray as the arm portions of the support member resiliently deflect outwardly from a center axis of the support member to be received within and overlap the cut-out engagement portion;

a rotary member configured to support the support member; and a pedestal configured to rotatably support the rotary member and weighted to hold a posture of the stirring device when the first tray is rotated, wherein the first tray and the support member are engaged with each other by engagement portions provided on the support member engaging with the cut-out engagement portion, the engagement portions provided on the support member including convex portions having a substantially triangular cross section that project from an inward side of the pair of arm portions.

2. The stirring device according to claim 1, wherein a second tray is stacked and engaged with the support member.

3. The stirring device according to claim 1, wherein each arm portion comprises one of the engagement portions.

4. The stirring device according to claim 1, wherein the support member and the rotary member are integrally formed.

5. A stirring device comprising:

a plurality of trays each configured to hold an ink container filled with ink;

a set member configured to set the plurality of the trays;

a support member configured to support the set member, the support member comprising a base with a pair of arm portions, wherein with a center of the base being a rotational axis, the pair of arm portions are formed to have a two-fold rotational symmetry, wherein the support member supports the set member as the arm portions of the support member resiliently deflect outwardly from a center axis of the support member to be received within and overlap cut-out portions of the set member;

a rotary member configured to support the support member; and a pedestal configured to rotatably support the rotary member and weighted to hold a posture of the stirring device when the first tray is rotated;

wherein the set member and the support member are engaged with each other by engagement portions provided on the support member engaging the cut-out portions of the set member, the engagement portions provided on the support member including convex portions having a substantially triangular cross section that project from an inward side of the pair of arm portions.

6. The stirring device according to claim 5, wherein each arm portion comprises one of the engagement portions.

7. The stirring device according to claim 5, wherein a mounting portion configured to mount at least one of the plurality of trays is formed in the set member.

8. The stirring device according to claim 7, wherein the set member includes a slip-off preventing portion configured to prevent one of the plurality of trays from slipping off.

* * * * *